US006679780B1

(12) United States Patent
Shih

(10) Patent No.: US 6,679,780 B1
(45) Date of Patent: Jan. 20, 2004

(54) POLYOMINO PIECE FOR GAMES

(76) Inventor: Sywan-Min Shih, 668, Wild Rose La., San Dimas, CA (US) 91773

( * ) Notice: Subject to any disclaimer, the term of this patent is extended or adjusted under 35 U.S.C. 154(b) by 0 days.

(21) Appl. No.: 10/273,128

(22) Filed: Oct. 18, 2002

(51) Int. Cl.[7] ..... A63F 9/12
(52) U.S. Cl. ..... 473/157 R; 273/156; 446/125
(58) Field of Search ..... 273/153 R, 157 R, 273/156, 161; 446/120, 121, 124, 125

(56) References Cited

U.S. PATENT DOCUMENTS 3,374,917 A * 3/1968 Troy ..... 446/125
D255,039 S * 5/1980 Gale ..... 446/124
4,678,192 A * 7/1987 Campbell ..... 273/157 R
5,000,713 A * 3/1991 Cheng ..... 446/120
5,009,625 A * 4/1991 Longuet-Higgins ..... 446/92
5,098,328 A * 3/1992 Beerens ..... 446/125
5,617,691 A * 4/1997 Yamamoto ..... 446/125
6,439,571 B1 * 8/2002 Wilson ..... 273/157 R

* cited by examiner

*Primary Examiner*—Steven Wong
(74) *Attorney, Agent, or Firm*—Rabin & Berdo, P.C.

(57) ABSTRACT

A polyomino piece includes a cube with six sides. Five sides of the cube each have four openings defined therein and arranged in two rows and two arrays. The remainder sixth side of the cube has two openings catercorner defined along a diagonal of the sixth side, and two first lugs catercorner formed along the other diagonal of the sixth side. A plurality of polyomino pieces can be combined to form various patterns, and the first lugs are hidden inside the patterns and cannot be seen at the outer surfaces, so that the patterns have nice appearances and can be stably placed.

11 Claims, 11 Drawing Sheets

POLYOMINO PIECE FOR GAMES

BACKGROUND OF THE INVENTION

1. Field of the Invention

The present invention is related to games and puzzles, and more particularly to a polyomino piece for games.

2. Description of Related Art

U.S. Pat. No. 5,868,388, titled "Games And Puzzles", illustrates a plurality of pentominoes each combined by five polyomino pieces and formed as a cross and letters "I", "L", "T", "U", etc. A set of pentominoes available on the market generally includes twelve configurations with various shapes as described above. Using these pentominoes, a player can form and construct various patterns and models.

The configurations of the pentominoes are limited in the products available on the market, so that the player is restricted to these configurations, and cannot freely combine polyomino pieces to construct patterns.

Patterns or models also can be formed by using LEGO® bricks or the like. Each of the LEGO® bricks generally has a plurality of lugs formed on a side thereof and an opening within a cylinder formed in the side opposite to the lugs. Bricks are connected together by means of inserting the lugs of some bricks in the corresponding openings of relative bricks to form the patterns or models. However, no matter how these bricks are arranged or combined, the lugs can be always seen at outer surfaces, and the patterns or models thus have an ugly appearance. Sometimes, due to these lugs being protruded from the outer surfaces, the patterns or models may be placed unstably.

Therefore, the invention provides an improved polyomino piece to mitigate and/or obviate the aforementioned problems.

SUMMARY OF THE INVENTION

The main objective of the invention is to provide a polyomino piece by which a pattern is formed with a nice appearance and good stability.

Another objective of the invention is to provide a polyomino piece which can be freely combined to form various patterns.

Other objects, advantages and novel features of the invention will become more apparent from the following detailed description when taken in conjunction with the accompanying drawings.

DETAILED DESCRIPTION OF THE PREFERRED EMBODIMENT

Figure 1:
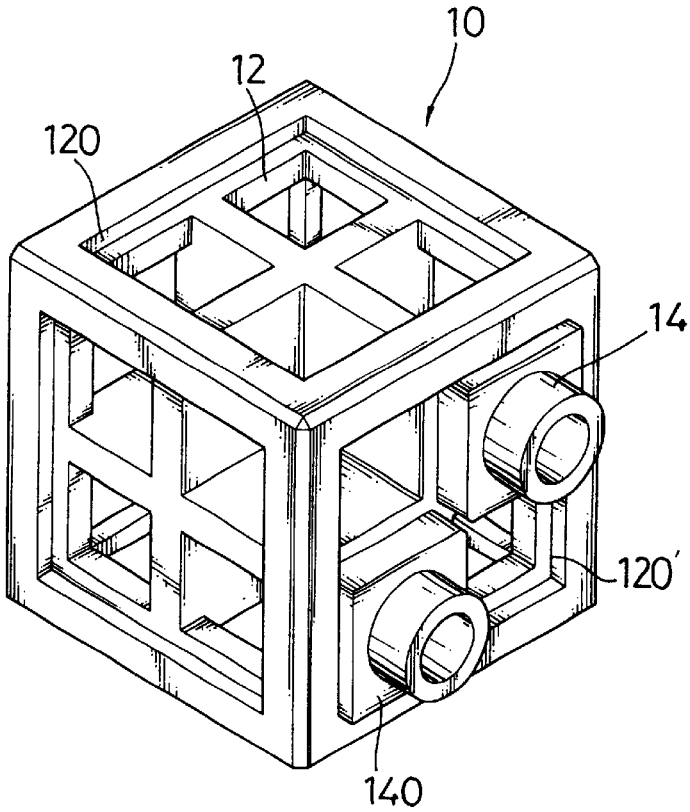
FIG. 1 is a perspective view of a first embodiment of a polyomino piece in accordance with the invention.

Referring to FIG. 1, a polyomino piece in accordance with the invention has a cube (10) with six sides. Five sides of the cube (10) each have a first recess (120) and four openings (12) defined in the first recess (120) and arranged in two rows and two arrays. The remaining sixth side of the cube (10) has two second recesses (120') catercorner defined along a diagonal thereof, two openings (12) respectively defined in the second recesses (120'), and two blocks (140) catercorner formed along the other diagonal thereof and slightly protruded from the sixth side. Two first lugs (14) are respectively formed on the blocks (140). In this embodiment, the first lug (14) has a round cross-section.

Figure 2:
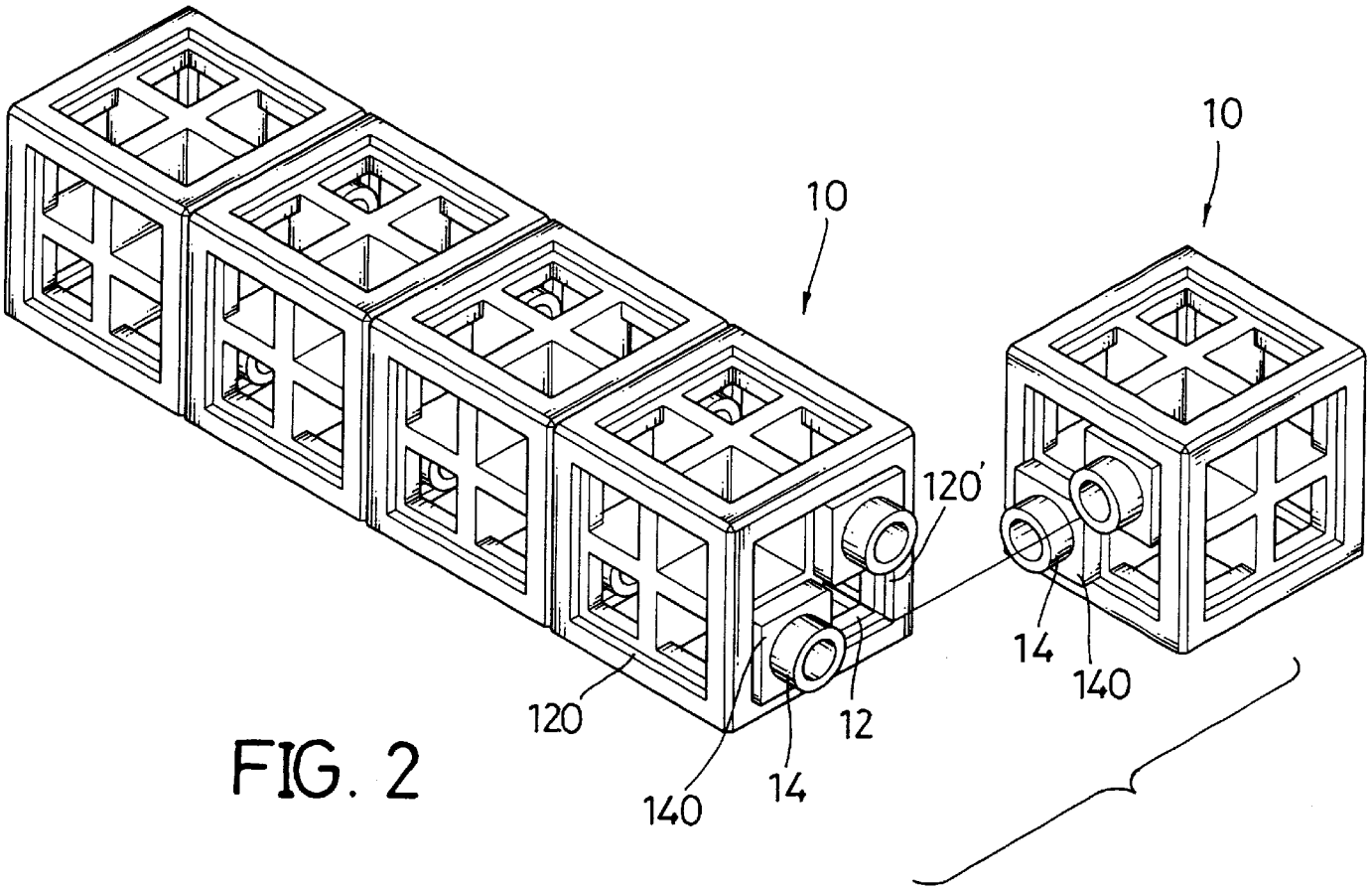
FIG. 2 is a perspective view of an I-like pattern combined by the polyomino pieces in FIG. 1, wherein one polyomino piece at an end is removed for clarity.

Referring to FIG. 2, a plurality of polyomino pieces, for example, five, is in series connected together to form a letter "I". The first lugs (14) of a former polyomino piece are inserted in the corresponding openings (12) of the latter polyomino piece on the side opposite to the first lugs (14). The first lugs (14) of the last polyomino piece face the former polyomino piece, and are respectively inserted in the openings (12) beside the first lugs (14) of the former polyomino piece. At the same time, the first lugs (14) of the former polyomino piece are respectively inserted in the openings (12) beside the first lugs (14) of the last polyomino piece, so that no first lug (14) can be seen at the outer surfaces of the pattern.

By the first lugs (14) inserted in the openings (12) and the blocks (140) engaged in the second recesses (120'), the cubes (10) are tightly and stably connected together.

Figure 3:
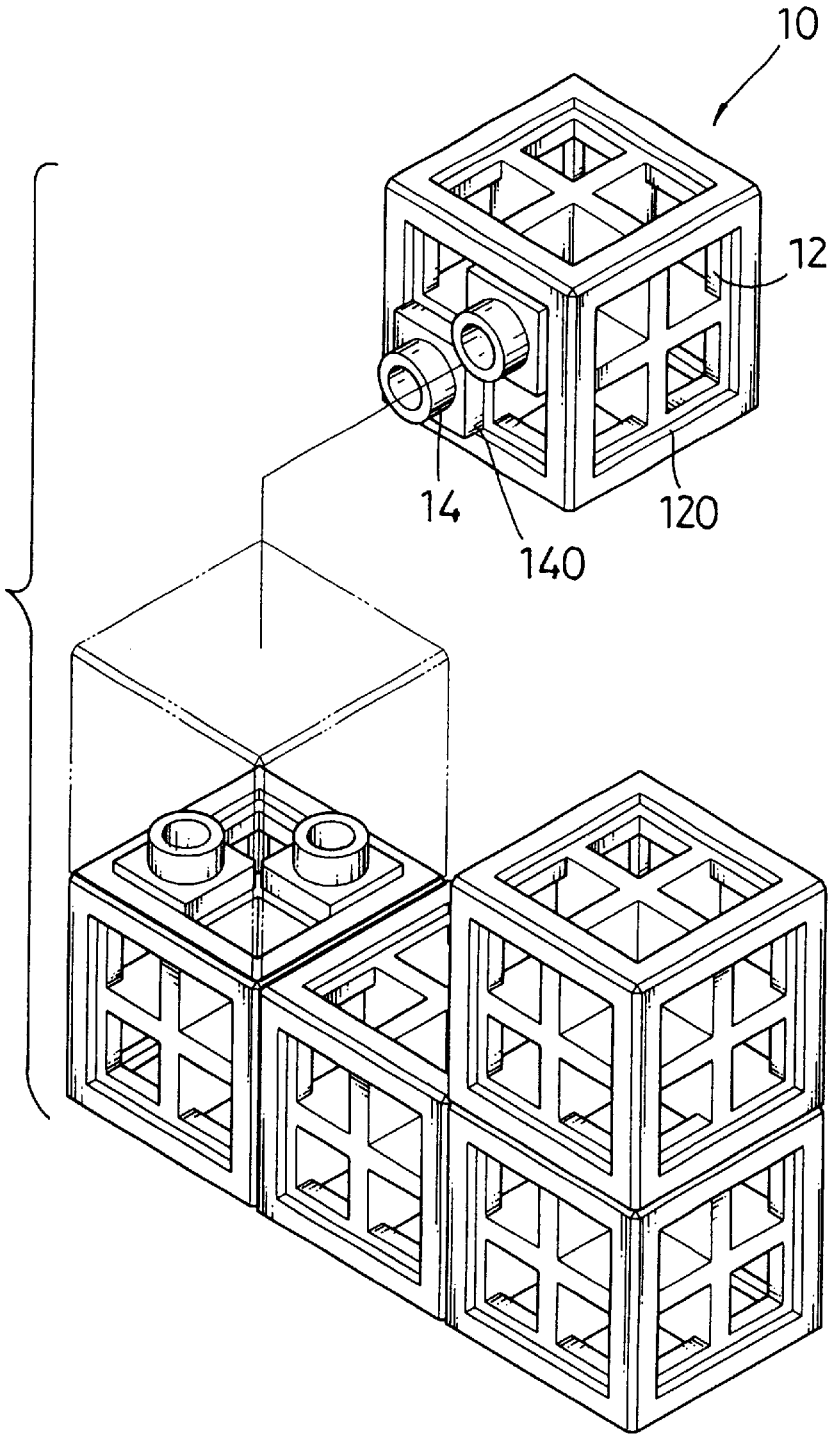
FIG. 3 is a perspective view of a U-like pattern combined by the polyomino pieces in FIG. 1, wherein one polyomino piece at an end is removed for clarity.
Figure 4:
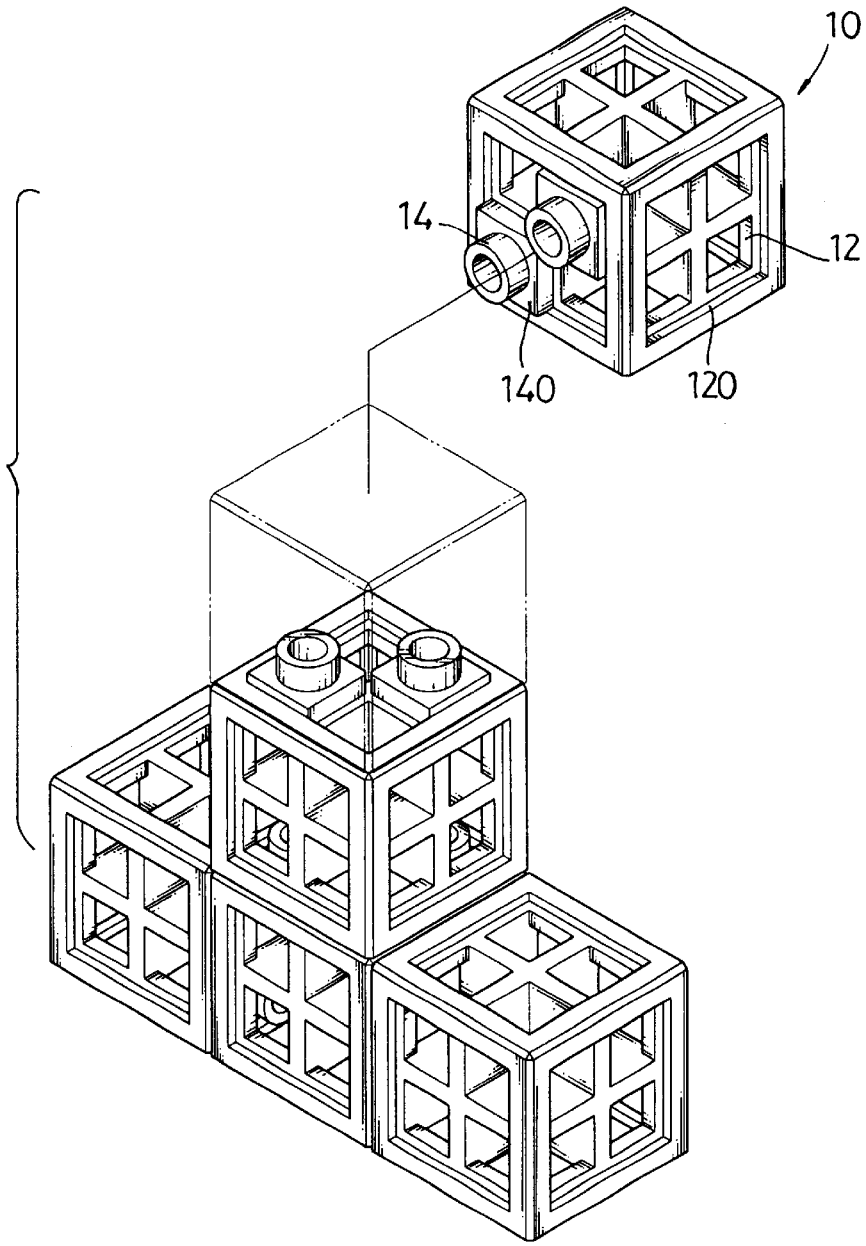
FIG. 4 is a perspective view of a T-like pattern combined by the polyomino pieces in FIG. 1, wherein one polyomino piece at a distal end is removed for clarity.
Figure 5:
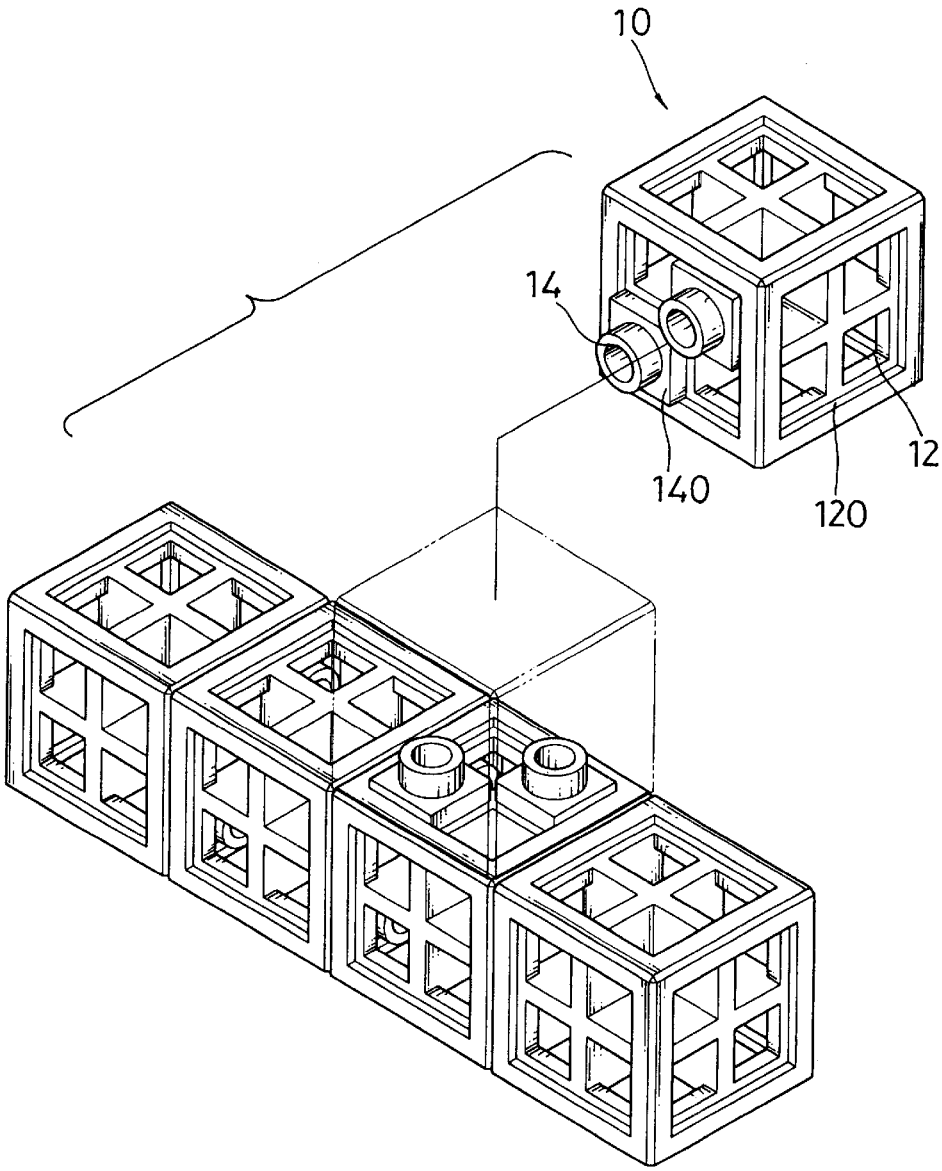
FIG. 5 is a perspective view of a Y-like pattern combined by the polyomino pieces in FIG. 1, wherein one polyomino piece at a distal end is removed for clarity.
Figure 6:
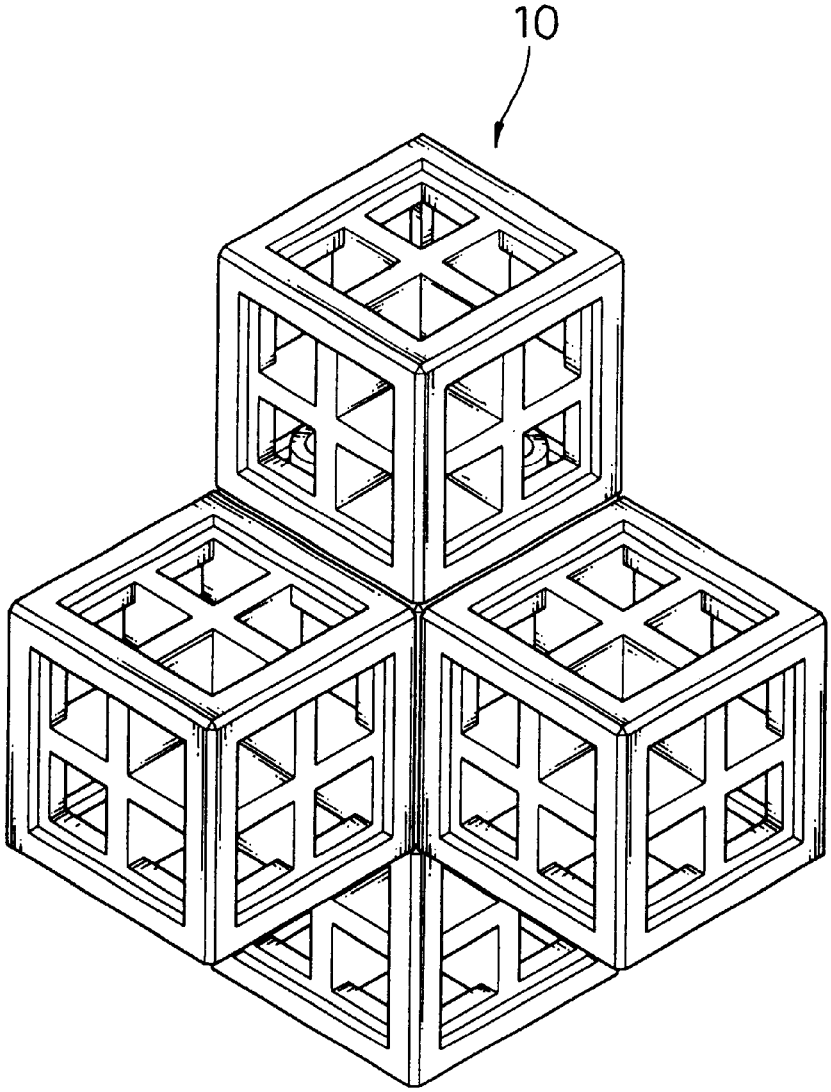
FIG. 6 is a perspective view of a three-dimensional pattern combined by the polyomino pieces in FIG. 1.

According to the principle and teaching of the present invention, using five polyomino pieces can make various patterns. FIG. 3 illustrates a pattern as a letter "U"; FIG. 4 illustrates a pattern as a letter "T"; FIG. 5 illustrates a pattern as a letter "Y"; and FIG. 6 illustrates a three-dimensional construction.

In all of these patterns, the first lugs (14) are hidden inside the patterns and cannot be seen at the outer surfaces, so that the patterns have nice appearances and can be stably placed. Furthermore, a player can freely combine cubes (10) to form different configurations, and will not be limited by the configurations of the conventional pentomino.

Figure 7:
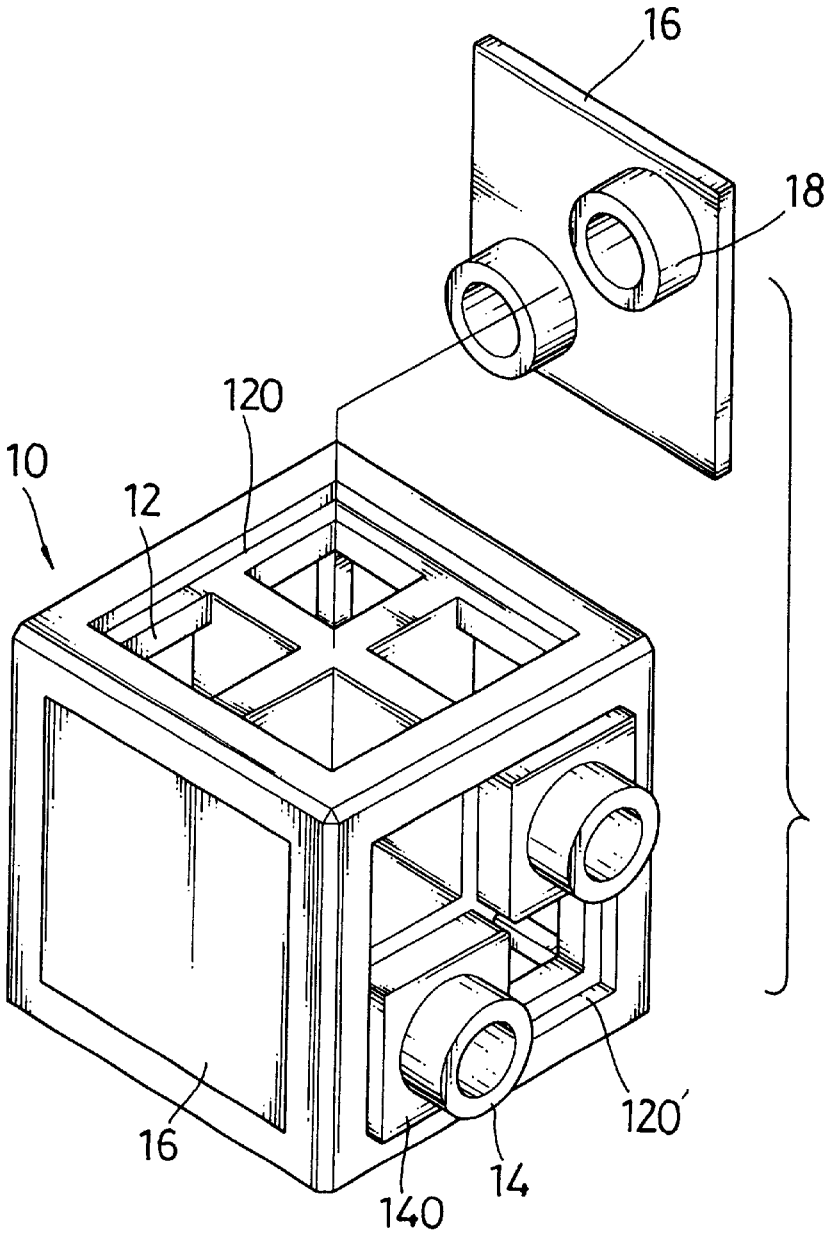
FIG. 7 is an exploded perspective view of the polyomino piece in FIG. 1 combined with side covers.

Referring to FIG. 7, according to the present invention, side covers (16) can be respectively attached in the first recesses (120). The side cover (16) has a thickness substantially equal to a depth of the first recess (120). When the side cover (16) is attached in the recess (120), the corresponding side surface of the cube (10) is flat and smooth. The side cover (16) further has two second lugs (18) catercorner formed along a diagonal of the side cover (16) and inserted in the corresponding openings (12).

Figure 8:
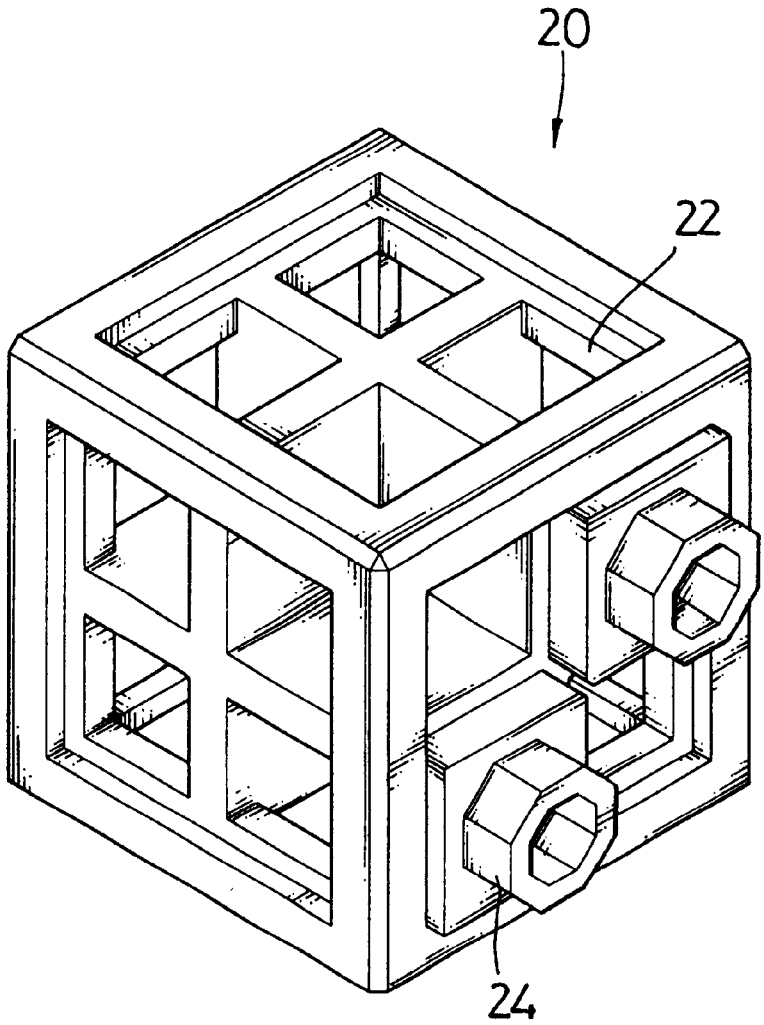
FIG. 8 is a perspective view of a second embodiment of a polyomino piece in accordance with the invention.
Figure 9:
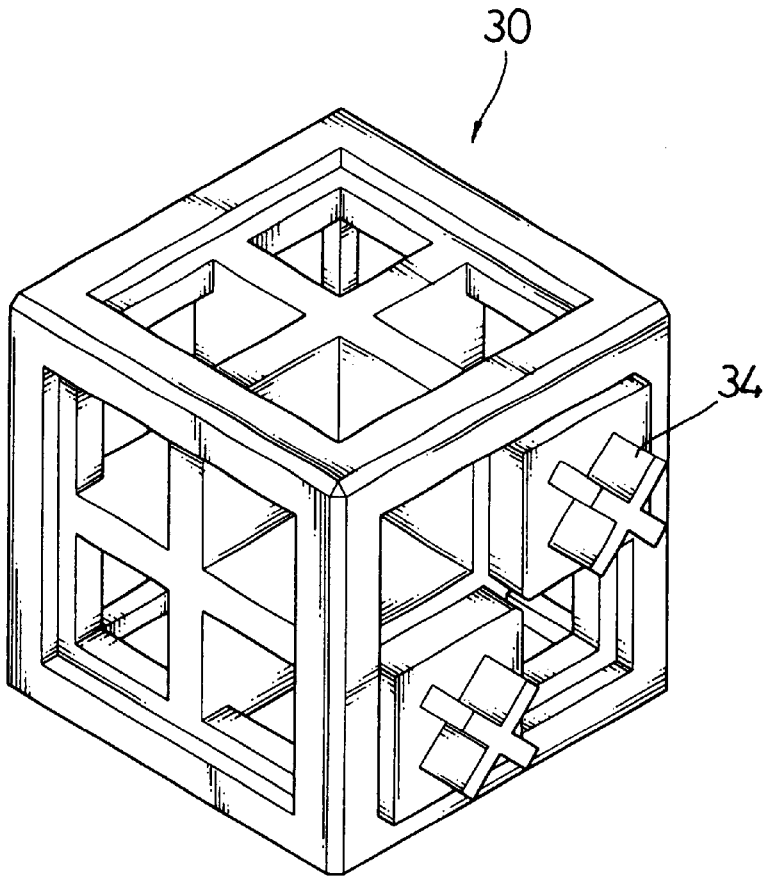
FIG. 9 is a perspective view of a third embodiment of a polyomino piece in accordance with the invention.
Figure 10:
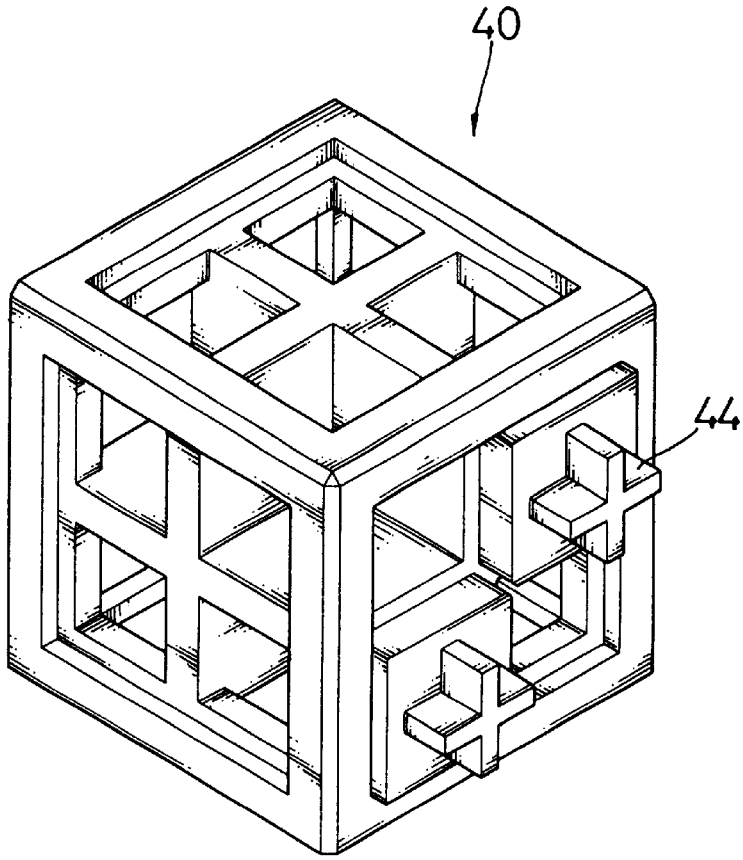
FIG. 10 is a perspective view of a fourth embodiment of a polyomino piece in accordance with the invention.

For detaching a side cover (16), a player can insert fingers through the openings (12) of a side beside the side cover (16) to push out the side cover (16). In a case that five side covers (16) are attached in the first recesses (120), the player can first insert fingers through the openings (12) in the second recesses (120') to push out the side covers (16) beside the second recesses (120'), and through the openings (12) in the first recesses (120) to push out the side cover (16) opposite the second recesses (120'). Referring to FIG. 8, in a second embodiment of the present invention, the polyomino piece has a cube (20) the same as that of the first embodiment but further has two lugs (24) each with an octagonal section. Referring to FIG. 9, in a third embodiment of the present invention, the cube (30) of the polyomino piece has two lugs (34) each with an X-like section. Referring to FIG. 10, in a fourth embodiment of the present invention, the cube (40) of the polyomino piece has two lugs (44) each with a cross-like section.

Figure 11:
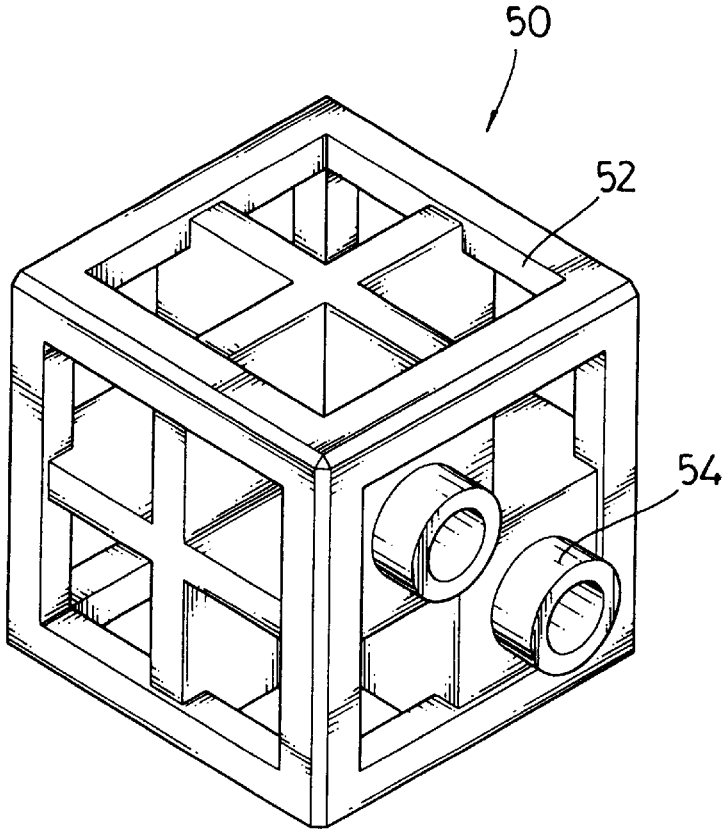
FIG. 11 is a perspective view of a fifth embodiment of a polyomino piece in accordance with the invention.

Referring to FIG. 11, in a fifth embodiment of the present invention, the cube (50) of the polyomino piece has only openings (52) and lugs (54) the same as those of the first embodiment but without recesses and blocks.

According to the present invention, patterns or constructions made by the polyomino pieces will have flat and smooth outer surfaces, so that these patterns or constructions have nice appearances and good stabilities.

It is to be understood, however, that even though numerous characteristics and advantages of the present invention have be en set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A polyomino piece for games, comprising:

a cube with six sides, wherein five of said six sides each has a first recess defined therein, and four arranged in two rows and two arrays and located in the first recess; a remaining one of said six sides having two openings catercorner defined along a one diagonal thereof and two first lugs catercorner formed along another diagonal thereof.

2. The polyomino piece as claimed in claim 1, wherein the remaining one of said six sides has two second recesses catercorner defined along the one a diagonal the two openings being respectively located in the second recesses.

3. The polyomino piece as claimed in claim 2, wherein the remaining one of said six sides has two blocks catercorner formed along the another diagonal, said first lugs being respectively formed on the blocks.

4. The polyomino piece as claimed in claim 1, further comprising at least one side cover attached in one of said five sides of the cube.

5. The polyomino piece as claimed in claim 4, wherein said side cover has a thickness equal to a depth of said first recess.

6. The polyomino piece as claimed in claim 4, wherein said side cover has two second lugs catercorner formed along a diagonal thereof and being insertable in corresponding ones of the four openings.

7. The polyomino piece as claimed in claim 5, wherein said side cover has two second lugs catercorner formed along a diagonal thereof and being insertable in corresponding ones of the four openings.

8. The polyomino piece as claimed in claim 1, wherein each said first lug has a round section.

9. The polyomino piece as claimed in claim 1, wherein each said first lug has an octagonal section.

10. The polyomino piece as claimed in claim 1, wherein each said first lug has an X-like section.

11. The polyomino piece as claimed in claim 1, wherein each said first lug has a cross-like section.

* * * * *